US005913839A

United States Patent [19]

Wincek

[11] Patent Number: 5,913,839

[45] Date of Patent: Jun. 22, 1999

[54] BALL-MASSAGING BOARD

[76] Inventor: Christopher P. Wincek, 8718-G E. Indian Hills Rd., Orange, Calif. 92869

[21] Appl. No.: 08/745,746

[22] Filed: Nov. 12, 1996

[51] Int. Cl.[6] ..... A61H 15/00

[52] U.S. Cl. ..... 601/134; 601/128; 601/115; 606/204

[58] Field of Search ..... 601/134–138, 601/128, 129, 131, 115, 118, 84; 606/204

[56] References Cited

U.S. PATENT DOCUMENTS

| | | | |
|---|---|---|---|
| Re. 19,696 | 9/1935 | Hemp | 601/129 |
| 857,761 | 3/1907 | Schmidt . | |
| 1,265,083 | 7/1918 | Hoard . | |
| 2,290,407 | 7/1942 | Collins | 601/131 |
| 2,633,844 | 4/1953 | Herndon | 601/128 |
| 3,205,888 | 9/1965 | Stroop . | |
| 3,881,469 | 5/1975 | Kanemitsu . | |
| 4,233,966 | 11/1980 | Takahashi . | |
| 4,374,519 | 2/1983 | Stauft | 601/128 |
| 4,577,625 | 3/1986 | Lohati . | |
| 4,688,556 | 8/1987 | Keller, Jr. . | |
| 5,103,808 | 4/1992 | Iams et al. . | |
| 5,165,390 | 11/1992 | Fleetwood | 601/128 |
| 5,183,034 | 2/1993 | Yamasaki et al. . | |
| 5,263,474 | 11/1993 | Agader . | |
| 5,352,188 | 10/1994 | Vitko . | |
| 5,416,936 | 5/1995 | Chan . | |

FOREIGN PATENT DOCUMENTS

| | | | |
|---|---|---|---|
| 365832 | 2/1960 | France . | |
| 743691 | 6/1943 | Germany . | |
| 4019902 | 11/1991 | Germany | 601/134 |
| 658989 | 9/1978 | Switzerland . | |

*Primary Examiner*—Richard J. Apley
*Assistant Examiner*—Benjamin K. Koo

[57] ABSTRACT

A ball-massaging board (14) molded out of plastic with a curved surface to comfortably support a person's spine in the supine position. Attached to the surface of board (14) are a number of rubber balls (15/16) that have a bolt head (18) bonded inside them, and a threaded portion (19) protruding outside them. Threaded portion (19) is inserted through a hole (21) in board (14), then secured in place by a lock nut (20). Because hole (21) is larger in diameter than the diameter of threaded portion (19) balls (15/16) are able to freely spin about the surface of board (14). Balls (15/16) are able to spin and roll simultaneously along the surface of board (14) while remaining attached to board (14). As an individual lies on the massaging board (14) and swivels his or her hips a combined spinning and rolling effect is created by balls (15/16) on the user's back and neck, simulating a real life massage. The user experiences deep penetrating massage therapy by lying on the entire diameter of balls (15/16) which effectively relieve trigger points throughout the entire back, shoulders, and neck, while rehabilitating various muscles.

2 Claims, 4 Drawing Sheets fig 1
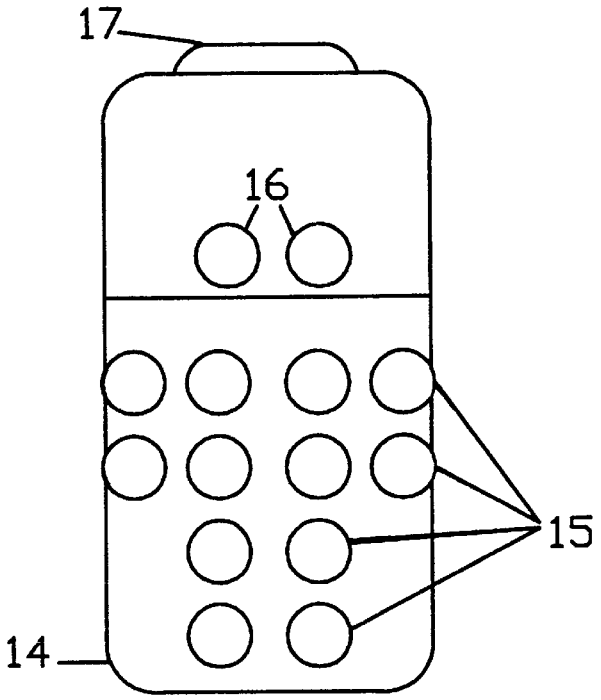
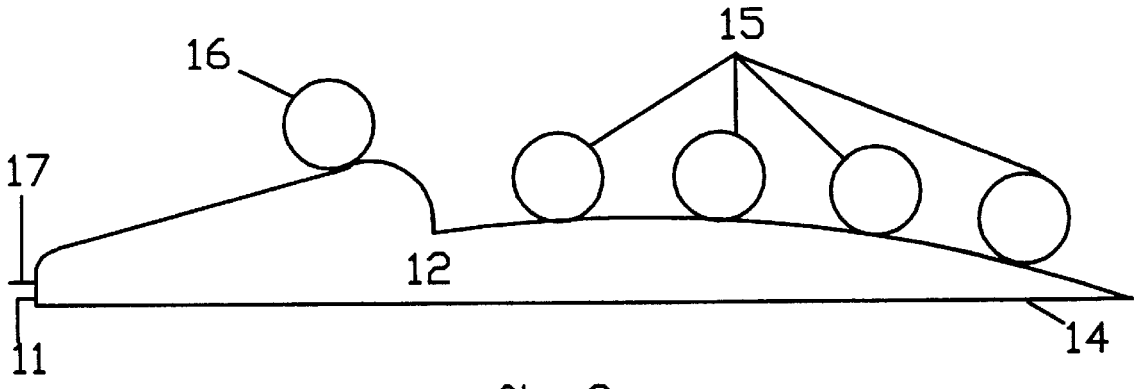
fig 2 fig 3
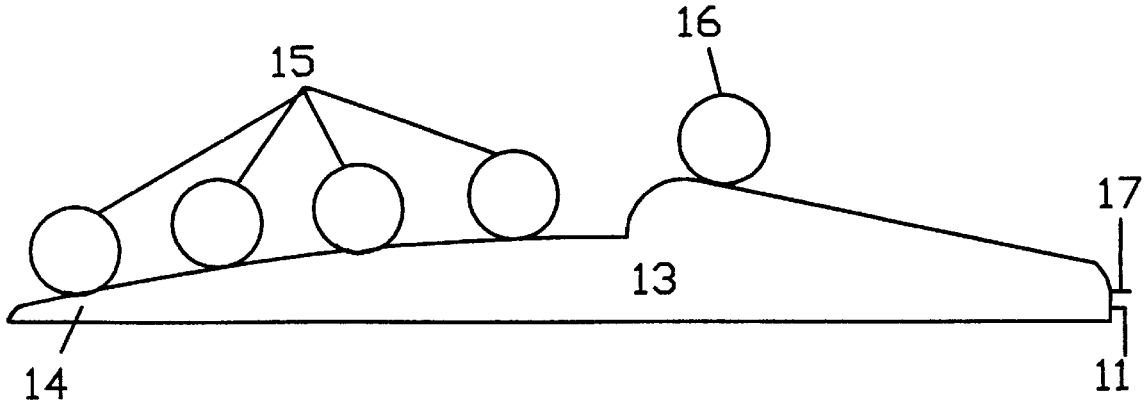
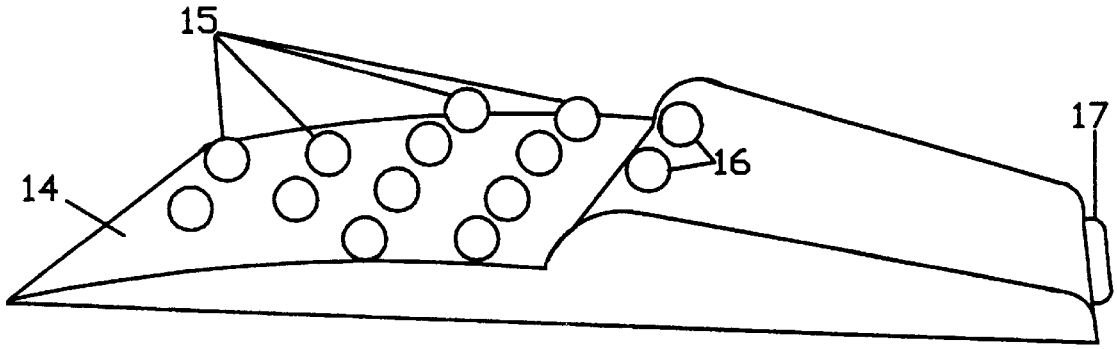
fig 4

BALL-MASSAGING BOARD

FIELD OF INVENTION

This invention relates to a back and neck massager, specifically to an improved self-administered ball massager that effectively combines deep massage therapy, trigger point stimulation and muscle rehabilitation.

BACKGROUND

This massager was invented out of the need for a very deep penetrating massage. After being diagnosed with a myofilation of the trigger point in his back, the inventor of this invention was told by a doctor to roll around on the floor on a tennis ball for therapy to massage the trigger point knot (myofilation). This simple type of therapy, rolling on a single tennis ball, is a common procedure many types of doctors and therapists recommended to their patients. In this therapy the ball is able to dig in deep to the person's back or neck and by moving his or her hips the ball will roll around the floor in any and every direction, creating a circular massage motion. This effectively kneads the sore or aching spots providing relief from the back or neck pain. Recognizing the benefits from this ball massage therapy also revealed some drawbacks. First a person lying flat on the floor can easily put adverse pressure and strain on one's lower back. Secondly, multiple balls worked better than one, but when lying and rolling around on a number of balls they slide too far apart from one another to remain effective. It is this invention that successfully overcomes the aforementioned drawbacks in one simple-to-use massaging device.

Orthopedic doctors, chiropractors, massage and physical therapists have long recognized the benefits of deep massage therapy, trigger point stimulation, and muscle rehabilitation. These types of therapies are known to be effective in providing relief to people suffering from back and neck pain, pain associated with stress, tension, sports and work related injuries, pain that many women experience during their menstrual cycle. Trigger point stimulation refers to the kneading or rubbing of specific reflex points on the body, points where muscles form knots. Many of these points are located in an individual's back or neck and are key areas to relaxing muscles. Deep massage therapy plays a major roll in massaging trigger points in that to effectively relieve a trigger point one must penetrate deeply into a person's back or neck. Muscle rehabilitation occurs when a muscle is deeply massaged, allowing oxygen to flow to the affected area of pain or soreness drawing out lactic acid, thus providing relief. The key to successful trigger point therapy and active muscle rehabilitation depends on the depth of penetration achieved during massage. The deeper the massage, the greater the relief.

Many devices have been developed throughout the years for the purpose of providing people with the means to massage one another or to even massage oneself. Many of these devices only merely provide a surface, vibrating type of massage. Some such as U.S. Pat. No. 5,352,188 (Vitko, 1994), and U.S. Pat. No. 5,263,474 (Agader, 1993) recognized the benefits from using balls in their inventions; however, by design, only a portion of the balls in these devices actually penetrate the user's back, neck or feet. That is, by the design of the frame or supports in these inventions, only the top portions of the balls actually penetrate the user, limiting the depth of massage. A few devices, such as Vitko's and Agader's, do achieve some success in providing a massage, yet in reality many significant flaws and limitations still exist with all known devices.

It is this invention that has successfully accomplished the task of combining a deep penetrating massage with trigger point stimulation and muscle rehabilitation in an inexpensive, easy to use, self-administered massaging board. This invention is effective on men, women, and children. It is inexpensive to manufacture, and thus is affordable to just about anyone who is looking for relief from unpleasant back and neck pain.

PRIOR ART

Known prior art does not include any inventions that fill the description of this invention. The most relevant prior art known is listed herewith and reference is made thereto.

U.S. Pat. No. 5,416,936 ROLLING-MASSAGING MATRESS OR CUSHION; H. C. Chan, 1995. This invention describes a magnetic mattress or cushion with cavities and frames that contain balls and beads. The balls are covered with upper layers limiting their depth and their effectiveness. The balls are made of a hard material, not soft rubber.

U.S. Pat. No. 5,352,188 COMBINED BACK AND NECK STIMULATOR AND REHABILITATION DEVICE; D. M. Vitko, 1994. This invention utilizes axles with balls that spin around on them, limiting the movement of massage to only one direction-backwards and forwards. The balls are not able to roll in any and every direction. They cannot simulate a persons thumb moving in a circle, but only a thumb that moves up and down. This is not realistic of a real massage. In addition, the balls are kept inside the frame and not on top. Thus, only the top portion of the balls are able to penetrate the user, limiting the depth of the massage. In order to adequately work, this device must be placed on a hard, smooth surface because the bottom of the balls are required to roll on the surface that it is placed upon. Finally, this device is not angled to alleviate pressure on the lower back.

U.S. Pat. No. 5,263,474 FOOT MASSAGING DEVICE; J. Agader, 1993. This invention is directed to a foot massaging device. This device also has limited depth of penetration of it's balls because they extend just a little bit above the carrier. The balls of this invention are set inside little compartments not attached directly to the carrier. This device would put adverse pressure on a person's lower back if they were to attempt to lie on it.

U.S. Pat. No. 5,256,269 PORTABLE VIBRATION FINGER PRESSURE MASSAGER; Y. Yamasaki, et al, 1993. This invention is directed to a portable massager with a drive worm, electric motor, and worm gears. Hard massaging elements move when a motor is turned on.

U.S. Pat. No. 4,688,556 SPINAL MASSAGE AND EXCERSISE DEVICE; M. A . Keller Jr, 1987. This invention also has a frame with the massaging elements inside of it, thus not allowing for the entire element to penetrate a person's back or neck. In addition, this device's massaging elements spin only in one direction due to its' axle design. This device also requires inflation of its elements to work effectively.

U.S. Pat. No. 4,577,625 ROTATING BALL MASSAGER; A. & G. Lohati 1986. This invention utilizes mitten and cushion-type ball massagers with axles that limit the direction of the massage, and cup holders with covers to hold the balls that limit the depth of penetration.

U.S. Pat. No. 4,233,966 APPLIANCE FOR USE IN ACUPRESSURE THERAPY; G. K. Takahashi, 1980. This invention is directed to an appliance which has a carrier with spherical, or globular, knobs inserted into various slots.

These massaging elements are hard and are unable to swivel or rotate. In addition, this device is flat which will put undo pressure on a user's lower back.

U.S. Pat. No. 3,881,469 MUSCLE RELAXING APPARATUS; S. Kanemitsu, 1975. This invention is directed to a massaging apparatus that utilizes axles for the roller elements, which allow for movement only in one direction as is the case with all the previous devices using axles. In addition, this invention has the roller elements within the frame, not on top of the frame. Thus, limited depth is accomplished.

U.S. Pat. No. 1,265,083 MASSAGE APPLIANCE; H. L. Hoard, 1918. This invention is directed to a flat device with handles and two posts. Massaging elements are moved around a set screw that locks the ball to a post, thus moving in only one direction. As stated in the patent "thus moving the handles 2 forwardly and rearwardly the balls 8, 8 or rollers 24, 24 are caused to move from the head downwardly along the neck and spine of the user, as indicated by dotted lines 20". Only an upward and downward motion is achieved, not a circular motion.

As seen from the above inventions as well as other previously developed devices, there are significant shortcomings with their functions and designs. These inventions fail to successfully provide a self-massager that allows for full penetration of the massaging elements, an angled carrier to properly support an individual's lower back, and massaging balls that spin in a circular motion. A brief listing of the reasons for these invention's failures are as follows:

A) Previous inventions utilize balls which spin around axles. A ball on an axle can only move in one direction or plane, thus limiting the effectiveness, and realness of the massage.

B) Previous inventions that utilize axles as roller means require their user to push and pull oneself which requires a lot of effort and energy.

C) Previous inventions require individuals to lie flat on the apparatus putting undo pressure and strain on the lower back.

D) Previous inventions have frames or carriers which keep the massaging elements inside the frame or carrier not directly on top, which prevents full penetration of the massaging element.

E) Previous inventions were too heavy for practical home application, especially those that utilize motors.

F) Previous inventions lacked durability by design.

G) Previous inventions required the assistance of another person to properly use the device.

H) None of the previous inventions known successfully combine back and neck rubber ball massage therapy in one easy to use device that effectively combines a support that wont put potentially harmfull pressure on one's lower back, and has balls that spin and roll in every direction while entirely penetrating the user.

Obviously, all of these problems do not apply to every prior invention in this field. However, with only scant commercial success of such devices, it is reasonable to conclude that most ball massagers developed to date are impractical and ineffective.

OBJECTS AND ADVANTAGES

Accordingly, several objects and advantages of this invention are as follows:

A) To provide a massaging device that, when properly used, will effectively produce a deep penetrating massage that successfully achieves widespread trigger point stimulation and active muscle rehabilitation of the back and neck areas.

B) To provide a massaging board apparatus that allows its user to lie on it without putting any undo pressure or stress on his or her lower back.

C) To provide a ball-massaging device that allows its user to self-administer his or her own massage by simply swiveling his or her hips.

D) To provide a massaging device that creates a real life simulation of someone's thumbs swiveling in a circular motion.

E) To provide a massaging board that can be used anywhere on any type of surface.

F) To provide a device that is durable, light-weight, portable and requires no batteries or electricity.

G) To provide a device that allows a number of rubber balls to be independently attached to a board in that each ball is able to swivel and roll in any and every direction while staying attached to said board.

H) To provide an affordable massaging device for all people by nature of its simple design and cost of manufacture.

I) To provide a ball massager that allows its user to lie on the entire diameter of the massaging ball.

Still, further objects and advantages will become apparent from the ensuing description and drawings.

BRIEF DESCRIPTION OF DRAWINGS

For a detailed description of a preferred embodiment of the invention, refer to the accompanying drawings:

FIG. 1 Shows a plan view of the invention.

FIG. 2 Shows a side view of the invention.

FIG. 3 Shows the opposite side view of the invention.

FIG. 4 Is an elevational, 3-D, view of the invention.

REFERENCE NUMERALS IN DRAWINGS

Figure 5:
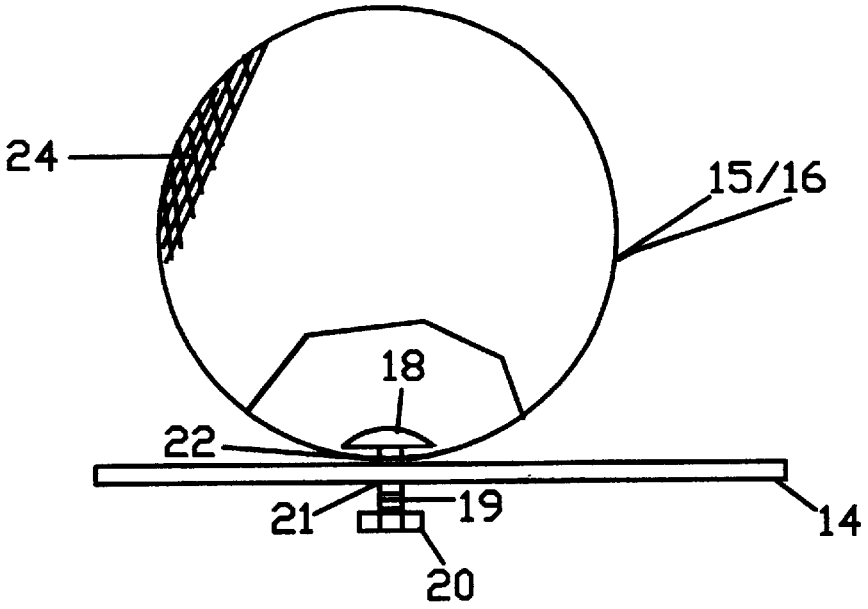
FIG. 5 Is a cut-away side view of the ball, board, and means of attachment.

11 Top edge wall of support board.
12 One side wall of support board.
13 The opposite side wall of support board.
14 Main support board.
15 Back and shoulder massaging balls.
16 Neck massaging balls.
17 Handle.
18 Bolt.
19 Threaded portion of bolt.
20 Lock nut.
21 Hole in support board.
22 Hole in massaging balls.
25 Axle.
26 Massaging ball.
30 Arrow indicating motion direction.
31 Arrow indicating rotation direction.
32 Arrow indicating rotation direction.

DETAILED DESCRIPTION OF THE INVENTION

Referring now to FIG. 1, there is shown a plan view of a preferred embodiment the instant invention. The device shown in FIG. 1 is comprised of a support board 14 which is a solid board approximately 3/16" thick. This board is a plastic material, such as HDPE, polypropylene, fiberglass, or something of the like, which is then vacuum-formed injection-molded into its current shape. Support board 14 has a plurality of balls mounted thereon. Each ball 15/16 is made of an elastic rubber compound. Each ball is hollow. The hollow rubber ball becomes slightly flattened, or elliptical in shape when in use. However, it is still firm enough to roll and swivel on board 14 when a person applies pressure to it.

All balls 15/16 are of the same diameter approximately 2.5". The balls are arranged in four columns and five rows. The first row has two balls 16 that are attached to the surface of board 14 at the highest point from the floor. These balls are in the center of the board, approximately two inches apart. The next two rows consists of four balls spaced about two inches apart. These two rows have four balls because the wide area of the shoulders rest here. The last two rows consist of two balls in each row located in the center of the board, about two inches from one another. They line up with the balls above them. These last two rows of balls are closest to the floor and are where the user's lower back rests during use. The two center columns are spaced approximately two inches apart in order not to rest directly on the spine, rather the balls treat the muscles on either side of the spine. Each row of balls are approximately 4.5" away from the row directly above or below it. The balls 15/16 are located on the surface of board 14 in a cross pattern to provide maximum trigger point and muscle stimulation. The last item noted in FIG. 1 is the handle 17. This handle is made of plastic and is attached to the top edge wall 11 of board 14. Its purpose is to provide an easy means for carrying board 14.

Referring now to FIG. 2, a side view of support board 14 is shown here. The five rows of balls are seen here. This embodiment indicates that board 14 is angled with a top edge wall 11 and a side wall 12. Items 11 & 12 are angled downward to form walls that rest on the ground. The height of item 11 is approximately 2.5" from the floor to the surface of board 14. The surface of board 14 begins to slope upward and away from edge 11 until it reaches approximately 4" in height where balls 16 are attached. The surface of board 14 then quickly slopes downward about 1.5"–2" and begins to slowly curve horizontally downward below balls 15, approximately 16" in length until it rests on the floor. Handle 17 is shown attached to edge 11.

In FIG. 3 board 14 is spun around to provide the view from the other side. Seen again here is the top edge wall 11, balls 16, and 15, handle 17, and the other side wall 13. By viewing FIGS. 2 and 3 one can easily see that when the board is molded it ends up with two sides 12 & 13 and a top edge 11. These items 11, 12, and 13 are molded down to the ground and are what give the board support and rigidity. The slope or curve of the surface of board 14, is also seen in this embodiment.

FIG. 4 shows a three dimensional view of board 14. From this view one can easily see the columns and rows of balls 15/16 and handle 17. This view is provided to better indicate the shape and angle of this massager. The curved shape of the board is critical to the effectiveness of the invention. It is angled, or curved, to match the natural curve in a person's spine. This prevents any undo pressure or stress on an individual's back when he or she lies on it.

Now referring to FIG. 5 there is shown a cut away view inside the massaging ball 15/16. In this embodiment the key concept to this massaging board is displayed. During the manufacture of balls 15/16, a bolt 18 is placed in a custom mold then ball 15/16 is molded and formed around bolt 18. The process of making balls 15/16 is similar to that of making a tennis ball. Two pieces of rubber are formed then they are placed together with an epoxy type compound, heated up, and the two halves then become bonded as one ball. What I have created is a step in this manufacturing process which allows bolt 18 to be placed into a custom mold before the two halves of rubber are bonded together to form the ball. By inserting bolt 18 into a mold, and placing additional rubber or glue all around and over the head of bolt 18 then continuing with the heating and bonding process, the bolt head is secured steadfast with threads 19 sticking outside of ball 15/16. After the bonding process, bolt 18 will not detach from ball 15/16, nor will it tear or rip due to the rugged design. In addition, the specified tensile strength, and durometer of the rubber compound keep the ball from splitting. An optional final felt wrap 24 is then placed all around the ball.

A slight hole 22, in the rubber allows the threaded portion 19 of bolt 18 to extend outside ball 15/16. Threaded portion 19 is then dropped through a hole 21 in board 14 which is slightly larger in diameter then the diameter of threads 19. By having hole 21 slightly larger than threads 19 the entire ball and bolt are able to spin around in a circle within hole 21. Thus the ball can swivel in a circular motion on the surface of board 14, as if one were to spin his or her thumb in a circle. Threaded portion 19 is then secured with a nylon lock nut 20 which will not back off when spinning. One can see how ball 15/16 will spin in a circular rotation. Furthermore, ball 15/16 not only spins but rolls at the same time. By putting a little pressure on the ball 15/16 one is able to move or roll it along the surface of board 14 in any direction while simultaneously spinning it. This concept of spinning and rolling together is unique to this invention and is what produces a real and effective massage.

Figure 6:
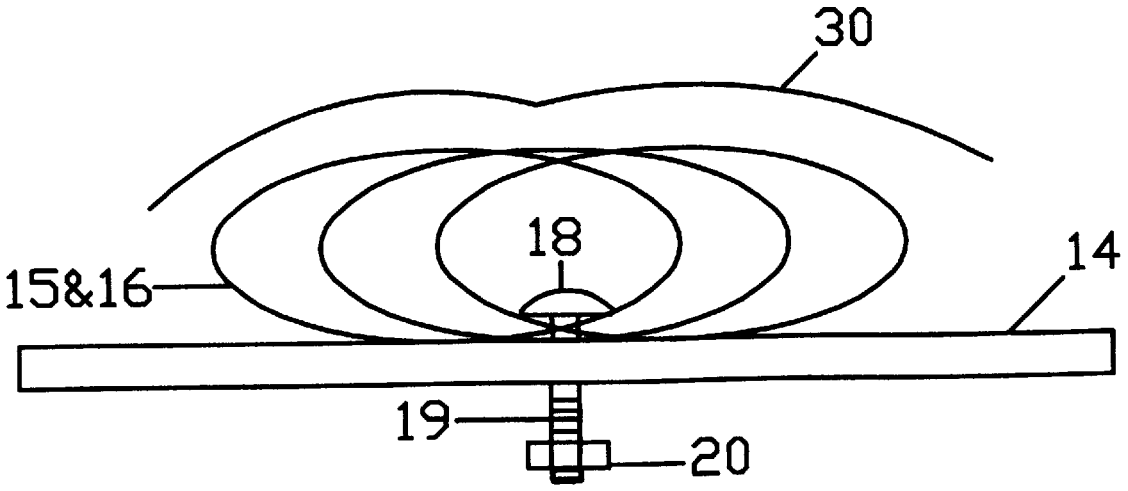
FIG. 6 Shows a cut-away, cross-sectional side view of the ball, board, attachment and indication of movement of the ball.

It is imperative to understand the combined concept of spinning and rolling. To further explain this concept refer now to FIG. 6. This cut-away cross-sectional side view shows board 14, ball 15/16, bolt 18, threads 19, and lock nut 20. An arrow 30 is provided to indicate the direction of motion that the ball can be pushed or rolled. In this embodiment ball 15/16 is shown in its flattened state indicating it can be slightly depressed yet still is able to roll. In this figure ball 15/16 is shown moving side to side indicating that the ball will roll but remain captive by the head of bolt 18. In reality ball 15/16 will not only roll side to side but will roll in any direction while remaining attached by the bolt head.

Figure 7:
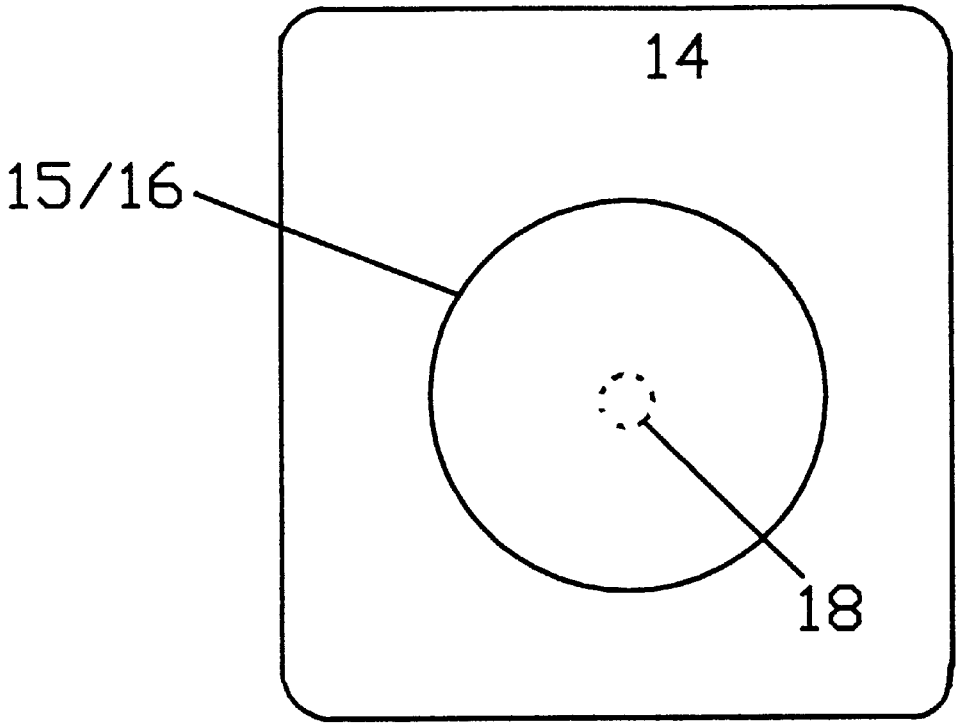
FIG. 7 Is a plan view of a portion of the board and one massaging ball.

The plan view of FIG. 7 will better describe this concept of movement. Shown here is a view of one ball 15/16 as it rests on a section of board 14. Bolt 18 is directly in the center of ball 15/16 holding it to board 14. The head of bolt 18 holds the ball secure to the surface of board 14. Since the head of bolt 18 is relatively small, approximately ¼" in diameter, and ball 15/16 is 2.5" in diameter, pressure or force can be applied to the ball 15/16 and it will roll or move approximately 2¼ in any direction. The 2¼ distance is the 2.5" ball diameter minus the ¼" bolt head diameter. Thus rolling movement is achieved in any direction while the ball stays secured to the surface of the board. The key point here is that the ball can be rolled in any direction: right or left, up or down, diagonally, etc. Ball 15/16 can roll in any direction or degree of a three hundred and sixty degree circle.

Figure 8:
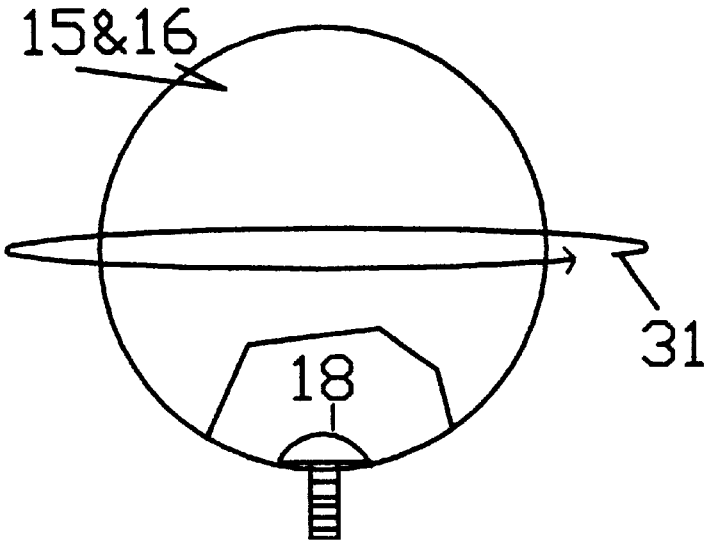
FIG. 8 Is another cross-sectional side view of massaging ball elements indicating the direction of ball rotation. This figure is included to further emphasize the different rotations between single bolt attachments versus axle attachments.

It is pertinent to further explain the difference in the way these massaging balls swivel versus the way many other massagers' balls swivel. FIG. 8 shows the difference in rotation between this invention's balls which work in conjunction with a bolt, or post, and that of previous invention's balls which work in conjunction with an axle. In this view, balls 15/16 are shown swiveling with bolt 18 in a horizontal axis; arrow 31 shows the pattern of movement. A ball that swivels along the horizontal axis, as the balls of this invention do, simulate a circular massaging motion, the same motion a masseuse would use with his or her thumbs.

OPERATION

The methods for using this massaging board are described. With board 14 placed on the floor an individual simply sits down next to the board with the two massaging balls 15 closest to the floor resting on his or her lower back. The balls that rest on the lower back are those at the opposite end from top edge 11. The user then slowly leans backwards until he or she is lying on the entire board 14. Balls 15 will be contacting the back and shoulder areas. Neck balls 16 will be pressing on the neck as the individuals head rests on board 14 near top edge 11 and handle 17. At this point the user notices the comfortable feeling of the board because the surface of board 14 is curved to match the curve of his or her spine.

The user now begins to swivel his or her hips in a circular motion which causes the massaging balls 15 & 16 to simultaneously rotate and spin in a circular direction. At this point the user experiences a very real and effective massage. Since the balls both spin and roll together, the user experiences an unexpectedly real life sensation of a massage. Since the user is lying on the whole ball, not just a portion of it like other massagers, he or she experiences a very deep penetrating feeling. This deep feeling is that of the entire balls 15/16 digging into the users back, shoulders and neck putting pressure on key trigger points and muscles. The user can use this device with his or her legs in a bent position or with the legs extended out on the floor. The only effort or energy required to make this massager work are the swiveling of the hips. It takes less effort to swivel ones hips than to push and pull ones legs muscles. However, it is possible with this invention to massage oneself by pushing and pulling ones legs because balls 15/16 will move back and forth as well as side to side or any other direction they are directed to move. Most people who use this device will agree that the most effective massage is accomplished by simply swiveling ones hips.

SUMMARY, RAMIFICATIONS AND SCOPE

Thus the reader will see that the massaging board of this invention allows its user to massage oneself quickly, safely, and extremely effectively. In just a few minutes a person is able to completely massage his or her back, shoulders, and neck, all at the same time. This unique curved board with rubber balls attached to its surface allows a person to lie on the entire diameter of the massaging balls which penetrate deeply into the user's back and neck. This deep penetration, combined with the fact that each ball is able to spin and roll simultaneously, creates a massaging sensation like never before achieved by a self massaging apparatus. The combined effects of this massager allows a person to isolate each trigger point or tender muscle. This massager is simple to use requiring little energy or effort. A person can give himself or herself a thorough massage, stimulate key trigger points, and actively rehabilitate his or her muscles by simply lying on the massaging board and swiveling his or her hips. An effective massage is achieved in just a matter of a few minutes. This device requires no electricity or batteries and is very economical to produce, making it affordable to millions of people. Men, women and even children can benefit from this device. Additional advantages are that it is durable, lightweight, self-administered, and can be used on any surface. Furthermore, should replacement balls be required, the user simply unscrews the lock nut, removes the old ball, then drops the threads of a brand new ball through the hole in the board. He or she then reattaches the lock nut, and they are ready to go with fresh, new balls.

While the above description contains many specifications, these should not be construed as limitations on the scope of the invention, but rather as an exemplification of preferred embodiments of this invention. Many other variations are possible for example, the massaging board 14 can be placed against a wall or couch and the user can simply lean against the board and move his or her hips to massage oneself Different colored rubber can be used to make the balls and different colored plastic can be used to make the board. The balls can be made to varying degrees of tensile strength thus affecting the softness of the massaging ball. And it is plausible that a mechanical device could be attached to the balls to generate a swiveling action allowing the user to remain stationary on the board.

Thus, the scope of the invention should be determined by the appended claims and their legal equivalents, rather than by the examples given.

What is claimed:

1. A back and neck massaging device comprising:

an angled, solid, support board having a flat surface adapted to support a person's spine in a supine position, said surface having a plurality of hollow resilient balls individually attached thereon, and a fastening post secured within each of said balls and extending out of said balls at a single location, said posts extending through a hole in said board and secured under said board, wherein said balls may spin about said post on said surface and are adapted to allow limited rolling movement across said surface.

2. The back and neck massager of claim 1 wherein:

said holes each having a diameter and said posts having a smaller diameter than the diameter of said holes to allow spinning movement of said balls about said posts.

* * * * *